United States Patent [19]

Krings

[11] 4,145,891

[45] Mar. 27, 1979

[54] SUPPORT ELEMENT FOR PIPE DITCHES

[76] Inventor: Josef Krings, Hans-Boeckler-Str. 23, D-5138 Heinsberg-Oberbruch, Fed. Rep. of Germany

[21] Appl. No.: 908,039

[22] Filed: May 22, 1978

[30] Foreign Application Priority Data

May 20, 1977 [DE] Fed. Rep. of Germany ..... 2722716

[51] Int. Cl.[2] ..... E21D 5/12

[52] U.S. Cl. ..... 405/282; 405/272; 405/283

[58] Field of Search ..... 61/41 A, 41 R, 63, 45, 61/105; 52/20, 21

[56] References Cited

U.S. PATENT DOCUMENTS

| | | | |
|---|---|---|---|
| 1,087,366 | 2/1914 | Haase | 52/20 X |
| 3,715,958 | 2/1973 | Crawford et al. | 52/21 |
| 3,937,026 | 2/1976 | Krings | 61/41 A |

FOREIGN PATENT DOCUMENTS

| | | | |
|---|---|---|---|
| 1123988 | 2/1962 | Fed. Rep. of Germany | 61/41 A |
| 1379604 | 2/1975 | United Kingdom | 61/41 A |

*Primary Examiner*—Dennis L. Taylor

*Attorney, Agent, or Firm*—Allison C. Collard; Thomas M. Galgano

[57] ABSTRACT

A support element for pipe ditches is provided which consists of support plates which are pressed against the ditch walls in pairs by longitudinally adjustable spreading means, and are guided and retained in vertical supports. The foot of at least one support plate includes a closable opening for guiding a branch pipe or the like, therethrough. Most desirably, the support plates are composed of two plates, an inner and an outer plate which are detachably coupled together and which have the same outer dimensions as a single support plate. The outer plate is provided with an opening in the area of the lower end thereof and the inner plate is movable between an open and closed position relative to the opening of the outer plate.

4 Claims, 6 Drawing Figures

Fig. 1
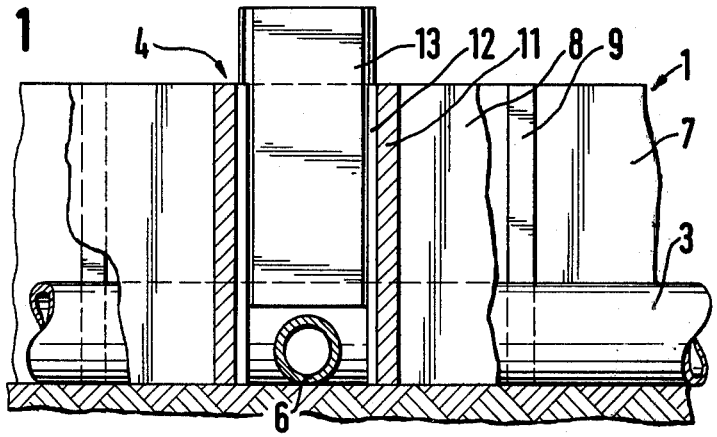
Fig. 2
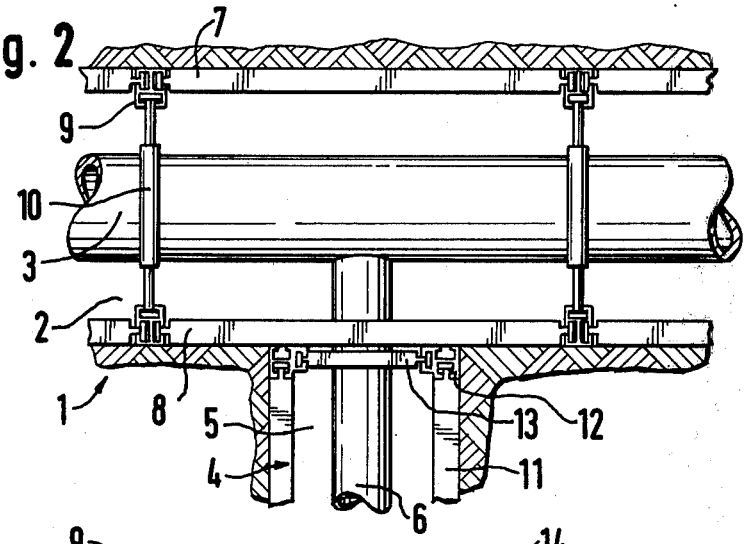
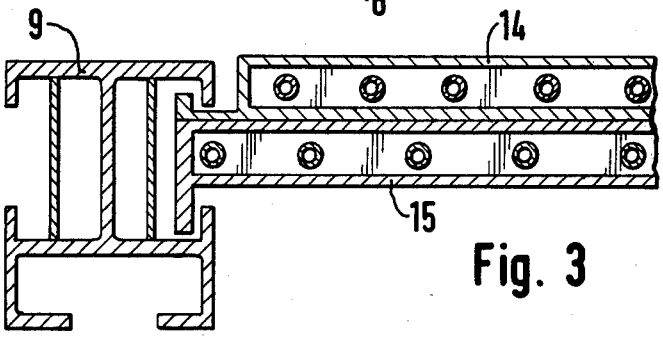
Fig. 3

SUPPORT ELEMENT FOR PIPE DITCHES

The invention relates to a support element for pipe ditches. More particularly, it relates to such a support element which consists of support plates which are pressed against the ditch walls in pairs by longitudinally-adjustable spreading means, and which are guided and supported in vertically-disposed supports.

When laying pipes in ditches or channels which are made secure by ditch support elements, it is often necessary to dig connecting branch ditches to buildings or other required branch ditches which run laterally or normally with respect to the main ditch and which also have to be made secure. Since the branch ditches normally require only a small cross-section, it is normally not feasible to interrupt the support plate in an area of 2 to 4 m. On the other hand, for the safety of the personnel who work in the ditches, it is required that suitable protection be provided in the lateral branch ditches, at least in the immediate area of the main ditch, as a result of which the branch ditches are normally dug at a lesser depth with increasing distance from the main ditch or the ditches are dug very close to the surface in the immediate area of the main ditch.

It is, therefore, an object of this invention to provide a device for securely protecting the side walls of the branch ditches.

This object of the invention is accomplished in that at the foot of at least one support plate a closable opening is provided for guiding a branch pipe or the like therethrough. Such an opening may be provided by a simple lockable cover plate or a flap. However, since with such a structure locking elements, pins, etc., are required which are subjected to corrosion, it is usually not desirable to use such a structure.

Hence, according to an advantgeous structure of the invention, a support plate having a closable opening is provided which actually consists of two individual plates, an inner plate and an outer plate, which are detachably connected with each other. The outer measurements of the two individual plates correspond to the outer measurement of a unitary plate. The single outer plate which is disposed to face the ditch wall is provided with a recess in the area of the lower edge thereof to define an opening therethrough and the single inner plate is closed in this opening area of the outer plate.

A support plate of the aforementioned type is already known from German Pat. No. 23 49 802. The novel support plate of the present invention distinguishes over this known plate by the arrangement of the opening in the range of one single plate. With this embodiment, it is possible to, initially, safely secure the ditch wall. When the branch pipe is to be extended through the branch ditch into the main ditch, it suffices to pull the inner plate upwardly to a certain extent, thus uncovering the opening. At the same time, the remaider of the support is essentially intact and ensures the required safety. The opening of the branch opening may be carried out in a manner whereby no personnel has to be present in the ditch, because the support plate which has to be lifted, may be lifted with a steam shovel.

In a further advantage embodiment, the outer single plate is coupled in a known manner with a wedge-like foot portion, the upper edge of which is shaped as a console or bracket for the inner single plate. The foot portion is interrupted in the range of the opening, and the inner single plate is coupled with a protrusion which extends over the opening of the foot portion.

In a further embodiment of the invention, the wedge-shaped foot portion is constructed in its cross-section as an isosceles triangle, with its symmetric line (i.e., the line bisecting the vertex and perpendicular to the base), positioned on the separating plane between the two single plates.

In order to enable the branch pipes to be led out substantially at any given place of the support plate, in accordance with a further embodiment of the invention, the wedge-shaped foot portion is composed of adjacent individual sections which are detachably coupled with the outer plate and the foot portion which is coupled with the inner plate is detachably mounted at various places along the total length of the inner single plate. With such a structure, it is possible to construct the foot portion in such a manner that it can be built up in an assembly of unit parts, so that the opening may be provided at the desired position.

Other objects and features of the present invention will become apparent from the following detailed description when taken in connection with the accompanying drawings which disclose several embodiments of the invention. It is to be understood that the drawings are designed for the purpose of illustration only, and are not intended as a definition of the limits and scope of the invention disclosed.

In the drawings, wherein similar reference numerals denote similar elements throughout the several views:

FIG. 1 is a fragmentarilly-illustrated, side elevational view, in part section, of a novel support element embodying the present invention, supporting the side walls of a main and branch ditch in which a main and branch pipeline are respectively disposed;

FIG. 2 is a plan view of FIG. 1;

FIG. 3 is an enlarged, horizontal cross-sectional view taken through a part of the support element;

Figure 4:
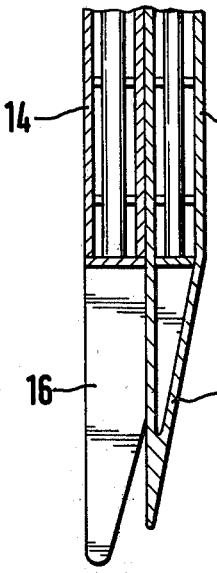
FIG. 4 is an enlarged, vertical cross-sectional view taken through a part of the support wall, which constitutes one embodiment of the present invention.

Referring now to FIGS. 1 and 2, the ditch support essentially includes a support element 1 for the main ditch 2 of a main pipeline 3, and a support element 4 which is disposed at a right angle with respect to main ditch 2 and which is used for a branch pipeline 6 which is layed in a branch ditch 5.

Support element 1 consists of support walls 7, 8 which are positioned at each side of the ditch and are held in supports 9. Longitudinally-displaceable spreading means 10 are retained in vertical supports 9 and push the support walls 7, 8 against the ditch walls.

Support element 4 for the branch ditch is disposed in a perpendicular position with respect to support element 1, and is similarly assembled. Support element 4 consists of support walls 11 which are positioned at both walls of branch ditch 5 and which are retained in vertical-disposed supports 12. Support walls 11 will be pushed against the branch ditch walls by spreading means (not shown). Instead of the superimposed spreading means, a further support wall 13 is provided on supports 12, parallel to support wall 8 of support element 1 which has a smaller longitudinal spreading effect corresponding to the smaller cross-section of the branch ditch. In the smaller ditch branches, such a support wall 13 may also be provided with spreading means.

A closable opening is provided at the foot of support wall 8 for extending a branch pipe 6 therethrough. This closable opening may be provided by a simple detachable lid or cover plate. Support wall 13 can be pulled upwardly from support element 4, so as to accommodate the required height for the branch pipe which has to be guided through the opening.

As can be seen in FIGS. 3–6, an improved embodiment of a support plate with a lockable opening comprises a two-unit support plate which includes two superimposed, individual plates 14, 15 the outer dimensions and shape of which correspond substantially to the outer dimension and shape of a single plate. The two single plates 14, 15 are slidable with respect to each other, if so desired by providing a sliding bar. Details of such a plate is disclosed in German Pat. No..23 49 802.

A difference in the two-plate structure is that the wedge-shaped foot 16, 17, which is coupled to the lower face of the inner plate 14 facing the ditch wall, is interrupted in the range of the opening.

At this point of the support, a rigidly-connected foot portion 18, 19 which corresponds to the wall thickness of inner single plate 14 is usually sufficient to close the opening.

When the wedge-shaped foot portion is assymetric, as shown in FIG. 4, so that its outside surface which faces the ditch wall forms an extension of support plate 14, foot portion 18 which is coupled with inner single plate 15 is positioned at a small distance in front of foot portion 16. A certain amount of permeability or leaking is permissible, since the opening has only very small dimensions.

Figure 5:
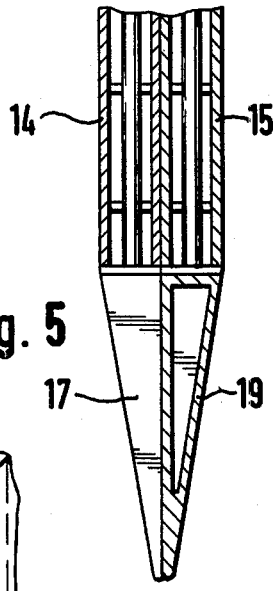
FIG. 5 is a cross-sectional view taken along line V—V of FIG. 6 through another support wall which constitutes another embodiment of the present invention.
Figure 6:
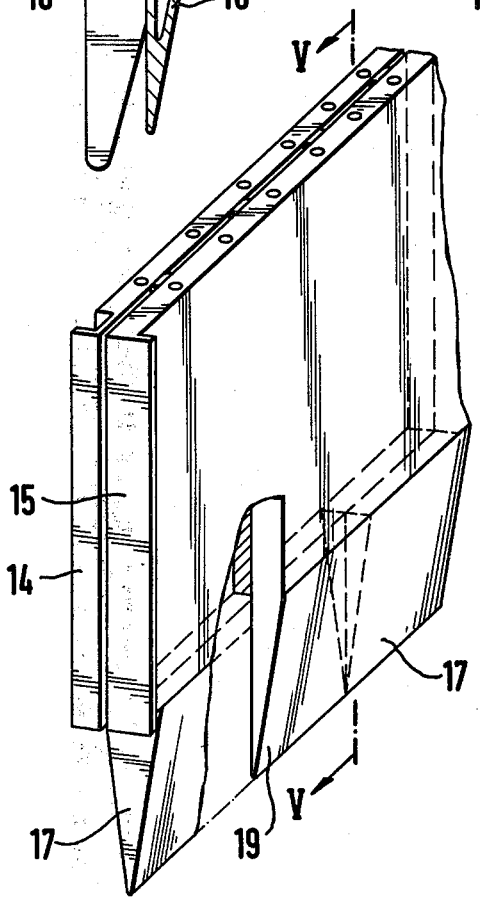
FIG. 6 is a fragmentarilly-illustrated perspective view of a support wall made in accordance with FIG. 5.

It is more advantageous, as shown in FIG. 5, that foot portion 17 is in the shape of an isosceles triangle, so that foot portion 19 which is coupled with single plate 15 occupies about one half of the profile cross-section.

If, during the construction, a branch line has to be constructed from the main ditch, the plate in accordance with FIG. 3 may be used so as to lift the inner singular plate 15 by the desired dimension. This does not interfere with the static of the wall, since the resulted weakening is carried out in the lower portion of the plate cross-section in an admissible or allowable way, so that the restraining force is maintained. At the same time, foot portion 16, 17 remains in the bottom of the ditch, so that only an opening for the branch line 6 is opened.

The structural plate 13, if sufficiently long, may be a two-part plate of the aforementioned type.

In order to guide the branch line 6 out of the main ditch at any given place, it is essential that foot portions 16, 17 and 18, 19 consist of a plurality of adjacent partial segments or sections which are detachably mounted on the lower edge or face of individual plates 14 or 15, respectively. This arrangement permits one to provide the opening at the beginning, in the center or at the end of the wall.

While only a few embodiments of the present invention has been shown and described, it will be obvious to those persons of ordinary skill in the art that many changes and modifications may be made thereunto without departing from the spirit and scope of the invention.

What I claim is:

1. An improved support element for pipe ditches in which pipes and the like are laid, of the type which includes support plates which are pressed against the opposing ditch walls in pairs by longitudinally-adjustable spreading means and which are guidably retained in vertical supports, the improvement comprising:

at least one of said support plates having a foot portion which is provided with a closable opening for guiding a pipe therethrough, said at least one support plate being composed of two plates, an inner plate and an outer plate which are detachably coupled together, the outer dimension of which correspond to the outer dimension of said at least one support plate, said outer plate being positionable against a ditch wall and having a recess in the area of the lower edge thereof which defines said opening, and said inner plate being movable between an open position and a closed, locking position relative to said opening defined in said outer plate.

2. The support element according to claim 1, wherein the outer plate includes a wedge-shaped foot portion coupled thereto, the upper edge of which is shaped as a bracket for receipt of said inner plate, said foot portion having a recess formed therethrough which defines said opening and said inner plate having a foot portion coupled thereto which extends into and covers the opening defined by said foot portion of said outer plate.

3. The support element according to claim 2, wherein said wedge-shaped foot portion has a cross-section in the form of an isosceles triangle and is disposed such that an imaginary line passing symmetrically therethrough lies within an imaginary plane separating said inner and outer plate.

4. The support element according to claim 2, wherein said wedge-shaped foot portion comprises a plurality of individual sections which are detachably coupled to said outer plate and wherein said foot portion which is coupled to said inner plate is detachably mounted at various positions along the total length of said inner plate.

* * * * *